US009115460B2

(12) United States Patent
Kissmann

(10) Patent No.: US 9,115,460 B2
(45) Date of Patent: Aug. 25, 2015

(54) COUPLING DEVICE FOR COUPLING A FRICTION DAMPER ON A WASHING MACHINE

(71) Applicant: SUSPA GmbH, Altdorf (DE)

(72) Inventor: Eberhard Kissmann, Sulzbach-Rosenberg (DE)

(73) Assignee: SUSPA GmbH, Altdorf (DE)

( * ) Notice: Subject to any disclaimer, the term of this patent is extended or adjusted under 35 U.S.C. 154(b) by 276 days.

(21) Appl. No.: 13/893,507

(22) Filed: May 14, 2013

(65) Prior Publication Data

US 2013/0306833 A1 Nov. 21, 2013

(30) Foreign Application Priority Data

May 15, 2012 (DE) ..... 10 2012 208 084

(51) Int. Cl.
*D06F 37/20* (2006.01)
*D06F 37/22* (2006.01)

(52) U.S. Cl.
CPC ..... *D06F 37/20* (2013.01); *D06F 37/22* (2013.01)

(58) Field of Classification Search
CPC ..... D06F 37/20; D06F 37/22; F16F 7/08; F16F 7/09
USPC ..... 248/638, 562, 610, 643; 188/321.11; 68/272, 269 R, 276
See application file for complete search history.

(56) References Cited

U.S. PATENT DOCUMENTS 2,828,146 A * 3/1958 Abbey ..... 137/614.01
2,849,777 A * 9/1958 Ridgers et al. ..... 174/42
3,157,291 A * 11/1964 Kulieke et al. ..... 213/62 A
3,219,373 A * 11/1965 Sutliff ..... 403/34
3,262,661 A * 7/1966 Johnson et al. ..... 248/562
3,385,541 A * 5/1968 Stelwagen ..... 248/562
4,618,171 A * 10/1986 Fahl ..... 285/93
4,934,493 A 6/1990 Bauer et al.
4,991,412 A 2/1991 Bauer et al.
5,680,918 A * 10/1997 Reik et al. ..... 192/55.1
6,273,229 B1 * 8/2001 Kimmig ..... 192/70.252
RE37,465 E * 12/2001 Reik et al. ..... 192/70.17
6,574,997 B1 * 6/2003 Mayer et al. ..... 68/23.1
2008/0128034 A1 * 6/2008 Fahl ..... 137/614.06
2013/0313399 A1 * 11/2013 Tsutsumi et al. ..... 248/638

FOREIGN PATENT DOCUMENTS

DE 3928141 C1 * 8/1990
EP 0 108 217 B1 1/1988
EP 0 336 176 B1 6/1993
EP 949373 A1 * 10/1999
EP 1 709 233 B1 6/2008

* cited by examiner

*Primary Examiner* — Jeanette E Chapman
(74) *Attorney, Agent, or Firm* — McGlew and Tuttle, P.C.

(57) ABSTRACT

A coupling device for coupling a friction damper onto a washing unit or a machine frame of a washing machine comprises a support part for supporting the friction damper with a support plate for putting on the washing unit or on the machine frame, with a support wall and with a pin having a pin longitudinal axis for mounting in a coupling opening of the friction damper, and a locking part coupled pivotably on the support part about a locking pivot axis between a locking position and an unlocking position, wherein the locking part comprises a fastening element, wherein in the locking position the support plate is secured onto the washing unit or the machine frame by means of the fastening element, and wherein in the unlocking position the support plate on the washing unit or on the machine frame is released by the fastening element.

20 Claims, 7 Drawing Sheets

COUPLING DEVICE FOR COUPLING A FRICTION DAMPER ON A WASHING MACHINE

CROSS-REFERENCES TO RELATED APPLICATIONS

This application claims the priority of German Patent Application, Serial No. 10 2012 208 084.8, filed May 15, 2012, pursuant to 35 U.S.C. 119(a)-(d), the content of which is incorporated herein by reference in its entirety as if fully set forth herein.

FIELD OF THE INVENTION

The invention relates to a coupling device for coupling a friction damper comprising at least one coupling opening onto a washing unit or a machine frame of a washing machine.

BACKGROUND OF THE INVENTION

EP 1 709 233 B1 discloses a coupling device of this kind with a support and a support body cooperating therewith.

SUMMARY OF THE INVENTION

An objective of the present invention is to improve a coupling device so that it is easier to use.

This objective is achieved in a non-obvious manner by a coupling device for coupling a friction damper comprising at least one coupling opening onto a washing unit or a machine frame of a washing machine, wherein the coupling device comprises a. a support part for supporting the friction damper, wherein the support part comprises
   i. a support plate for putting on the washing unit or machine frame,
   ii. a support wall extending away transversely from the support plate,
   iii. a pin having a pin longitudinal axis for mounting in the at least one coupling opening, wherein the pin extends away transversely from the support wall, and
b. a locking part coupled pivotably to the support part about a locking pivot axis between a locking position and an unlocking position for locking the friction damper onto the support part, wherein the locking part comprises a fastening element,
c. wherein in the locking position the support plate is secured onto the washing unit or onto the machine frame by means of the fastening element, and
d. wherein in the unlocking position the support plate on the washing unit or on the machine frame is released by the fastening element.

The core of the invention consists of configuring a coupling device in two parts, wherein a locking part is connected pivotably to a support part about a locking pivot axis. The coupling device is thus rotatable in itself This rotatability is particularly advantageous if a damper which is to be fastened by means of the coupling device onto a washing machine is configured such that the housing and ram are not rotatable relative to one another about a middle longitudinal axis. This is the case for example if the ram and/or the housing have a contour that is not round relative to the middle longitudinal axis. The locking part is pivotable between a locking position and an unlocking position. In the locking position a support plate of the support part can be secured onto a washing unit or a machine frame of the washing machine by means of the fastening element. In the locking position the coupling device is fastened securely and reliably onto the washing machine. At the same time a friction damper is held and locked with a coupling opening on a pin of the support part. In the unlocking position the support plate on the washing unit or on the machine frame are released by the fastening element. This means that in the unlocking position the support plate cannot be secured in the washing machine and in particular can be removed. In the unlocking position it is possible in particular to disassemble the support part for example together with the locking part. The handling of the coupling device is simplified in particular with regard to the assembly and disassembly in the washing machine.

A coupling device comprising a lever formed on the locking part for pivoting the locking part, wherein the lever extends transversely, in particular perpendicularly, to the locking pivot axis, is particularly advantageous to use. In particular, it is possible to activate the coupling device manually and in particular without using a tool. Because the locking part has a lever formed thereon, which is oriented transversely and in particular perpendicular to the locking pivot axis, it is possible in a particularly advantageous manner to exert a pivot torque manually on the locking part.

A coupling device, in which the locking part is made in one piece from a first material, in particular plastic, can be produced in an uncomplicated manner and in particular can be produced inexpensively in large numbers. The coupling device is particularly suitable for use in washing machines that are mass produced. Thus a rapid and inexpensive assembly of the damper in the washing machine is possible. In particular, the locking part is made of plastic and is produced in particular by an injection molding method. Producing the locking part by injection molding makes it possible to have a large variety of different designs. In particular, it is possible to integrate different functional elements on the locking part. The locking part is produced in one piece. In this way the locking part has a high degree of inherent stability. It is not necessary to piece together the locking part, for example in a previous assembly stage. The production of the coupling device, and in particular its assembly, is also simplified in this way.

A coupling device, in which the support part is made in one piece from a second material, in particular plastic, enables the simplified production of the support part and in particular the uncomplicated assembly of the coupling device. Furthermore, the one-piece support part has increased inherent stability and rigidity. The support part is made particular of plastic and in particular by an injection molding method. This has the same advantages as the production of the locking part in an injection molding method, and reference is made to this here.

A coupling device, in which the locking part and the support part are made from different materials, in particular from polypropylene and polyoxymethylene, has improved sound absorption behavior. Since the two parts forming the coupling device are made from different materials the sound emission is reduced, in particular structural-borne noise. Noises created by relative movements between the two parts are avoided.

A coupling device comprising at least one holding projection arranged on the support plate enables the improved fastening of the support part onto the washing machine, in particular onto the washing unit or the machine frame. In particular, two holding projections are provided on the support plate, by means of which projections the support plate is pushed in a locking position against a corresponding part of the washing machine. The two holding projections are used to ensure the positioning and non-rotation of the assembly group formed by the coupling device and the damper relative to a holder provided in the washing machine for mounting the assembly group. It is possible in particular to provide reinforcing ribs on the support plate, so that the rigidity and stability of the support plate and thereby the support part as a whole is increased. In particular, the transmission of structural-borne noise is reduced by the friction damper via the support part.

A coupling device, in which the fastening element is arranged in a recess provided in the support plate, provides an advantageous assembly of the support part with the locking part. Because the fastening element is arranged in a recess of the support plate, the recess is used as a pivot mount. The recess has a contour arranged parallel to a plane provided by the support plate, which is essentially configured to be in the form of a keyhole. The contour is open towards an edge of the support plate, so that the fastening element can be inserted into the recess of the support plate. The contour of the recess has a section which is curved at least in some sections and comprises an insertion section, whereby the width of the insertion section is smaller than the diameter of the curved section.

A coupling device, in which the fastening element comprises an axial fastening for axially securing along a direction oriented perpendicular to the support plate, enables the secure assembly of the locking part on the support part. Since the fastening element has an axial- fastening it is not possible for the locking part to be displaced unintentionally in a direction perpendicular to the support plate. In particular, it is possible in this way to attach the coupling device in the washing machine in a preassembled state, in which the locking part is held on the support part. In particular, it is possible that the coupling device is inserted with a premounted friction damper into the washing machine and is secured and locked there.

A coupling device comprising at least one latching element for latching the locking part onto the support part (17) in the locking position enables a secure arrangement of the locking part on the support part in the locking position. In this way the coupling device is prevented from becoming unintentionally detached from the locking position. In particular, this is ensured by the at least one latching element which is arranged in a latched position in the locking position.

A coupling device comprising a first latching element arranged in particular on a pin clamp, wherein the first latching element in the locking position is arranged latched in a corresponding first latching recess arranged in the pin also enables the axial securing of the friction damper on the pin along the pin longitudinal axis.

A coupling device comprising a second latching element, wherein the second latching element in the locking position is arranged in a corresponding second latching recess arranged in the support platem, ensures a high degree of locking security. Because a second latching element is latched into a second latching recess arranged in the support plate in the locking position, the stability of the coupling device is further increased. The opening of the locking part is prevented.

A coupling device, in which the second latching element is configured as a latching projection on a resilient latching tongue, which can be activated manually in particular in the locking position, enables the manual release of the arrangement of the second latching element from the latched arrangement. In addition, the second latching element comprises a latching projection which is coupled to a resilient latching tongue. The latching tongue can be activated manually such that the latching projection can be displaced from the second latching recess. In particular, the latching tongue is configured such that in the locking position the latching tongue projects at least in some sections laterally from the support plate and thus can be activated manually, in particular by pressing the latching tongue in a direction parallel to the locking pivot axis.

A coupling device comprising a holding plate arranged eccentrically to the locking pivot axis with a pin clamp, wherein the pin clamp in the locking position encompasses the pin at least in sections, and wherein the pin clamp in the unlocking position is arranged spaced apart from the pin, enables the additional securing of the locking part on the support part in the locking position. By means of a holding plate arranged eccentric to the locking pivot axis, which holding plate comprises a pin clamp, the holding plate can encompass the pin at least in some parts with the pin clamp in the locking position. In this case the pin clamp can be configured in particular to be C-shaped, wherein in particular the opening of the "C" is smaller than the external diameter of the pin. In particular, the holding plate is locked onto the pin in the locking position. In the unlocking position the pin clamp is arranged spaced apart from the pin. In this way in particular the assembly of the friction damper on the pin is made possible. The pin clamp ensures the additional axial securing of the friction damper on the pin.

A coupling device comprising at least one insertion chamfer arranged on a lower side of the fastening element facing towards the support plate enables the simplified securing of the fastening element in the washing machine. In particular, it also provided increased strength of the arrangement of the fastening element in a recess of the washing machine.

A coupling device, in which the fastening element is a bayonet bolt having a bolt longitudinal axis, enables the uncomplicated and reliable securing of the coupling device in the washing machine. In particular, a rotation of the locking element by 90° about a bolt-longitudinal axis is sufficient to lock the fastening element configured as a bayonet bolt onto the support part.

Features and details of the invention are provided in the description of an exemplary embodiment with reference to the drawings.

DESCRIPTION OF THE PREFERRED EMBODIMENT

Figure 1:
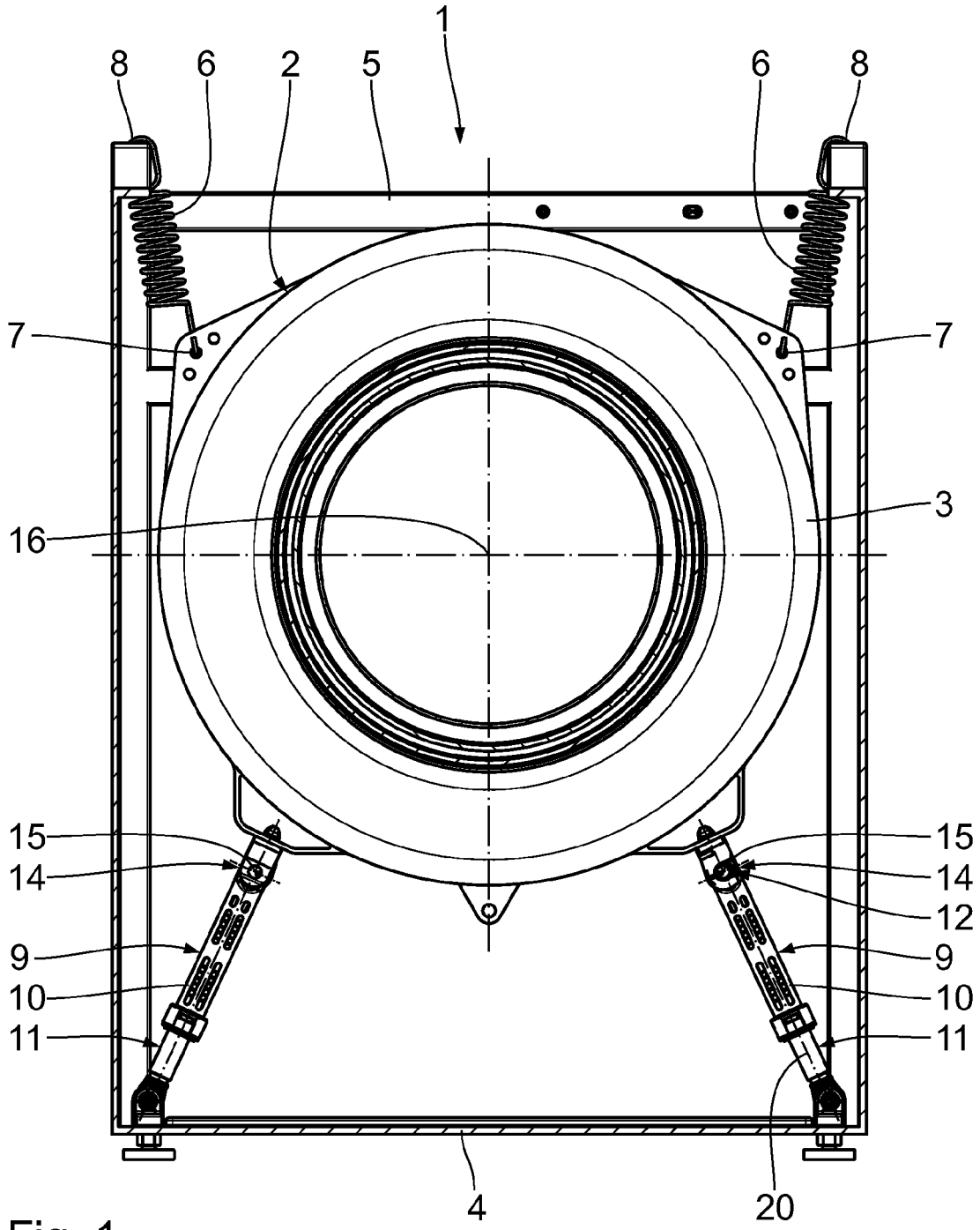
FIG. 1 shows a cross-sectional side view of a washing machine comprising two friction dampers arranged respectively between a machine frame and a washing unit.

A drum washing machine 1 shown in FIG. 1 comprises a vibratory washing unit 2 with a corresponding housing 3. In the housing 3 a washing drum, not shown in detail, is mounted to be rotary driven. The vibratory washing unit 2 is suspended on a washing machine housing 6 supported on a machined frame formed by a base frame by means of helical tension springs 6. The tension springs 6 are attached on the one hand to eyelets 7 which are secured in the upper part of the washing unit 2. On the other hand the tension springs 6 are suspended on eyelets which are formed on profile pipes 8 of the washing machine housing 5. The washing unit 2 is suspended or supported to vibrate freely. Instead of the tension springs 6 the washing unit 2 can also be supported by means of so-called spring legs on the machine frame 4, as known for example from EP 0 108 217 B1.

Between the washing unit 2 and the machine frame 4 friction dampers 9 are also arranged. A friction damper 9 of this kind is known for example from EP 0 336 176 B1. Each friction damper 9 comprises a housing 10 and a ram 11 guided out of the housing 10. The ram 11 and the housing 10 each have a rectangular cross section oriented perpendicular to a middle longitudinal axis 20. The ram 11 is not rotatable relative to the housing 10 about the middle longitudinal axis 20. Both the housing 10 and the ram 11 each have at a free end a coupling opening 12, into which a joint bush is inserted in the form of a rubber sleeve 13. The friction dampers 9 are attached by means of a coupling device 14 onto the housing 3 of the washing unit 2 so that the respective friction damper 9 is mounted pivotably about an axis of rotation 15 relative to the washing unit 2. It is possible alternatively or in addition to secure the friction dampers 9 respectively onto the machine frame 4 by means of an additional coupling device 14. It is also possible for one friction damper 9 to be secured by means of the coupling device 14 onto the washing unit 2 and the other friction damper 9 to be secured by means of the coupling device 14 onto the machine frame 4. The axis of rotation 15 is oriented parallel to a drum axis of rotation 16.

In the following the coupling device 14 is described in more detail with reference to FIGS. 2 to 7. The coupling device 14 comprises a support part 17 for mounting the friction dampers 9. Furthermore, the coupling device 14 comprises a locking part 18, which is coupled pivotably about a locking pivot axis 19 on the support part 17. The locking part 18 is used for locking the friction damper 9 on the support part 17. At the same time the locking part 18 is used for securing the coupling device 14 onto the washing unit 2. In a position of the friction damper 9 installed into the washing machine 1 the middle longitudinal axis 20 coincides with the locking pivot axis 19. The middle longitudinal axis 20 of the friction damper 9 is in particular oriented to be perpendicular to the axes of rotation 15.

Figure 2:
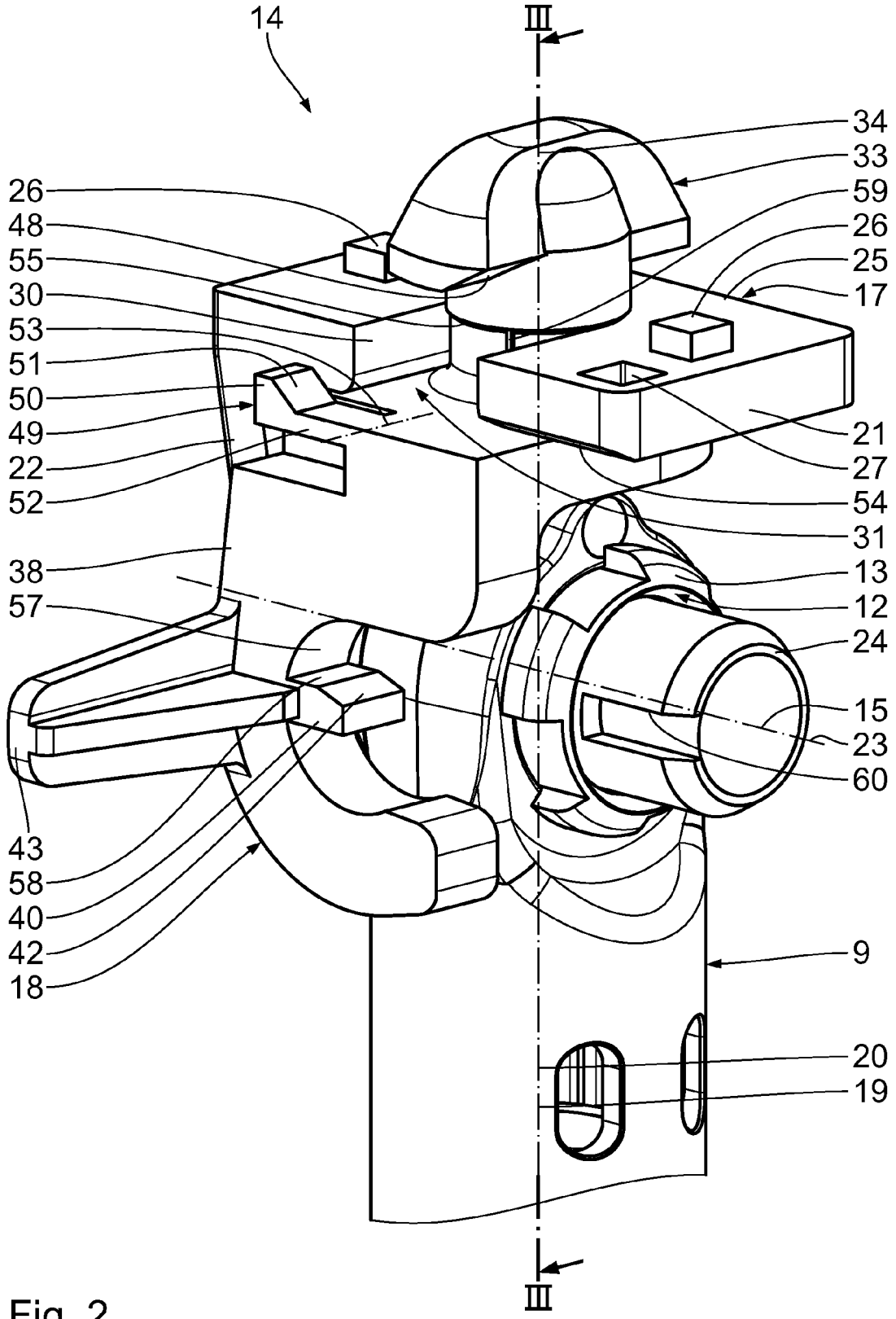
FIG. 2 shows an enlarged, perspective cut-out view of a coupling device according to the invention with a friction damper coupled thereon in an unlocking position.
Figure 4:
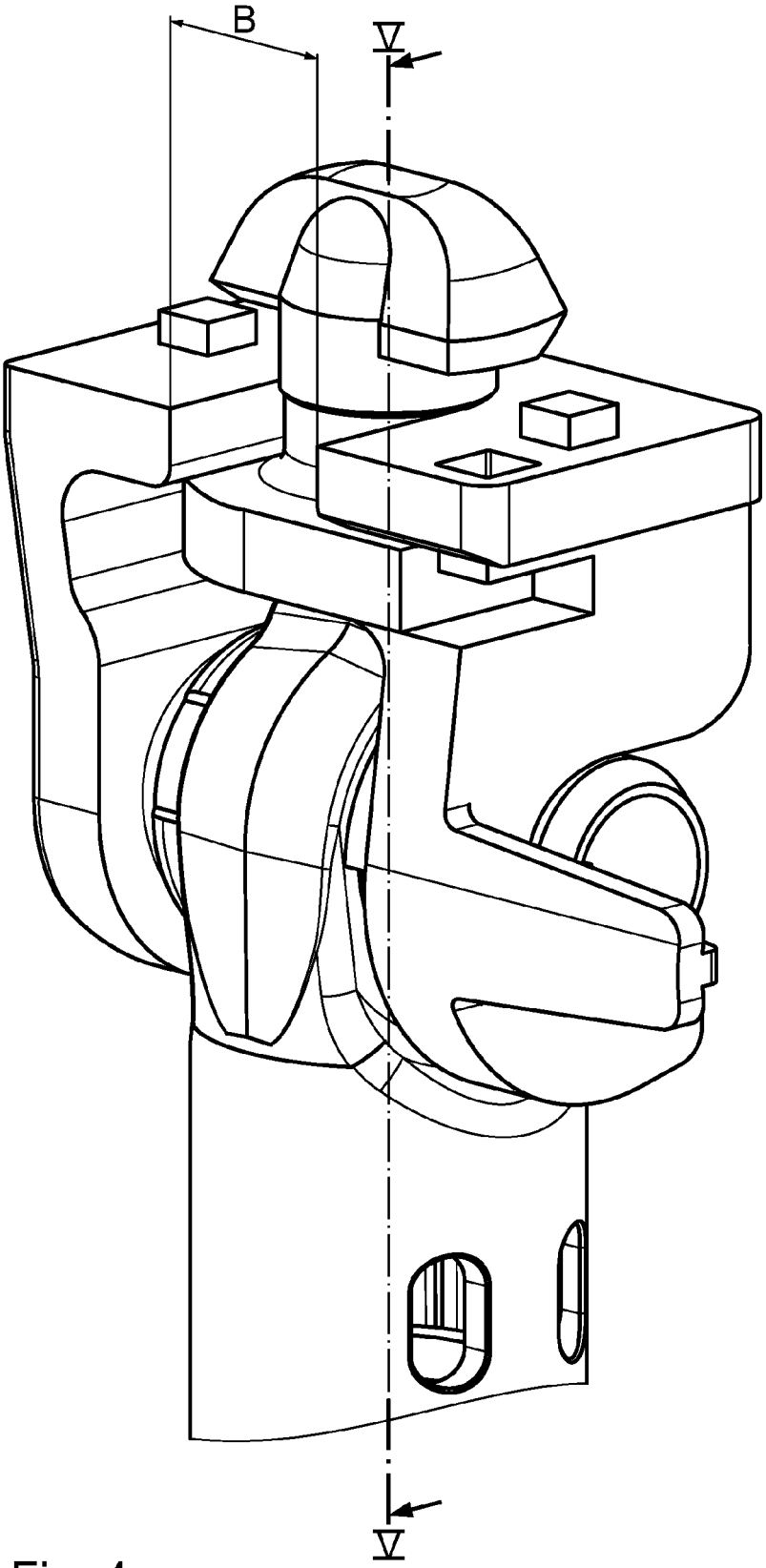
FIG. 4 shows a perspective view according to FIG. 2 in a locking position of the coupling device.
Figure 5:
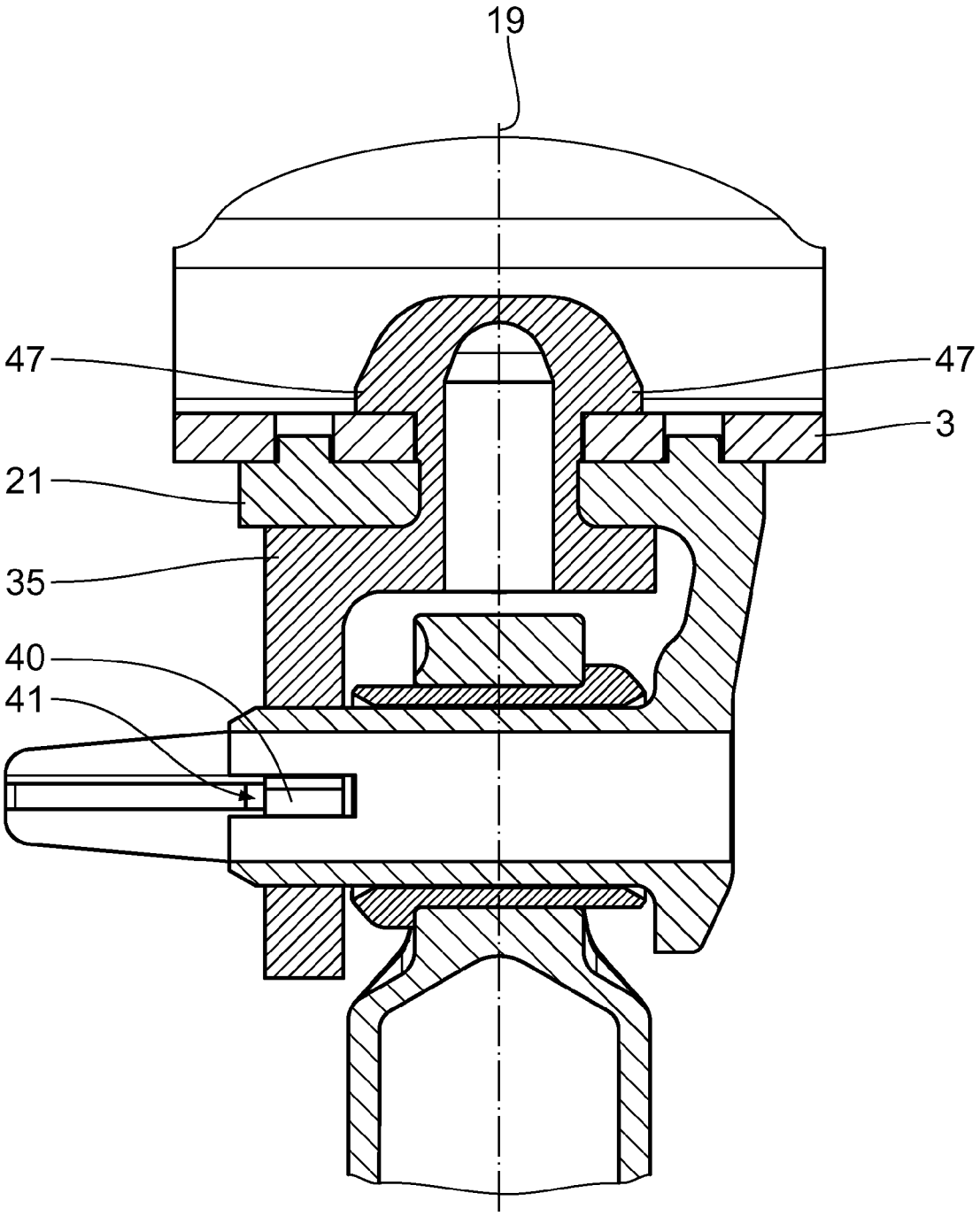
FIG. 5 shows a cross-sectional view according to line V-V in FIG. 4.
Figure 6:
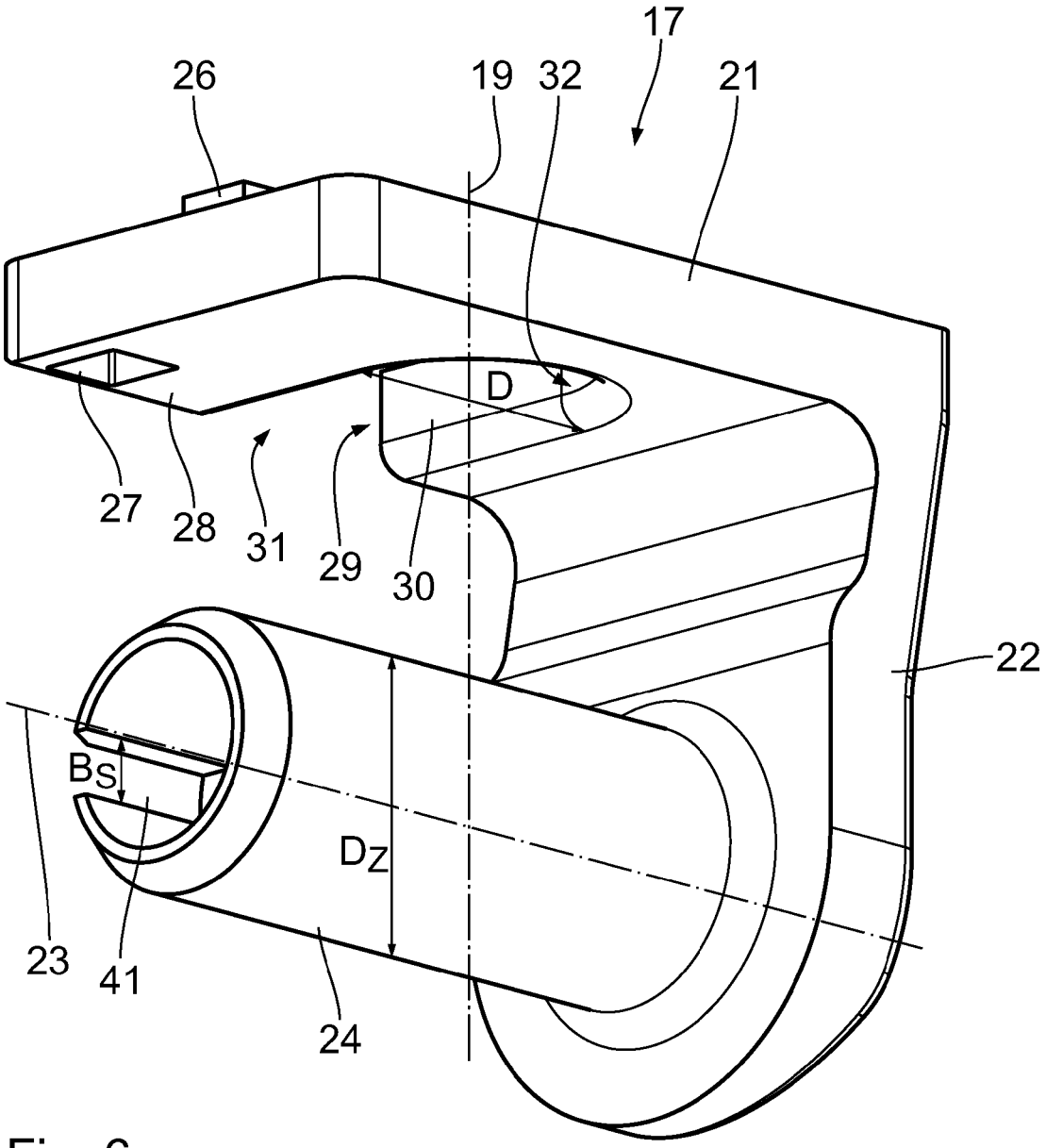
FIG. 6 shows a perspective view of a support part of the coupling device according to the invention and FIG. 7 shows a perspective view of a locking part of the coupling device according to the invention.
Figure 7:
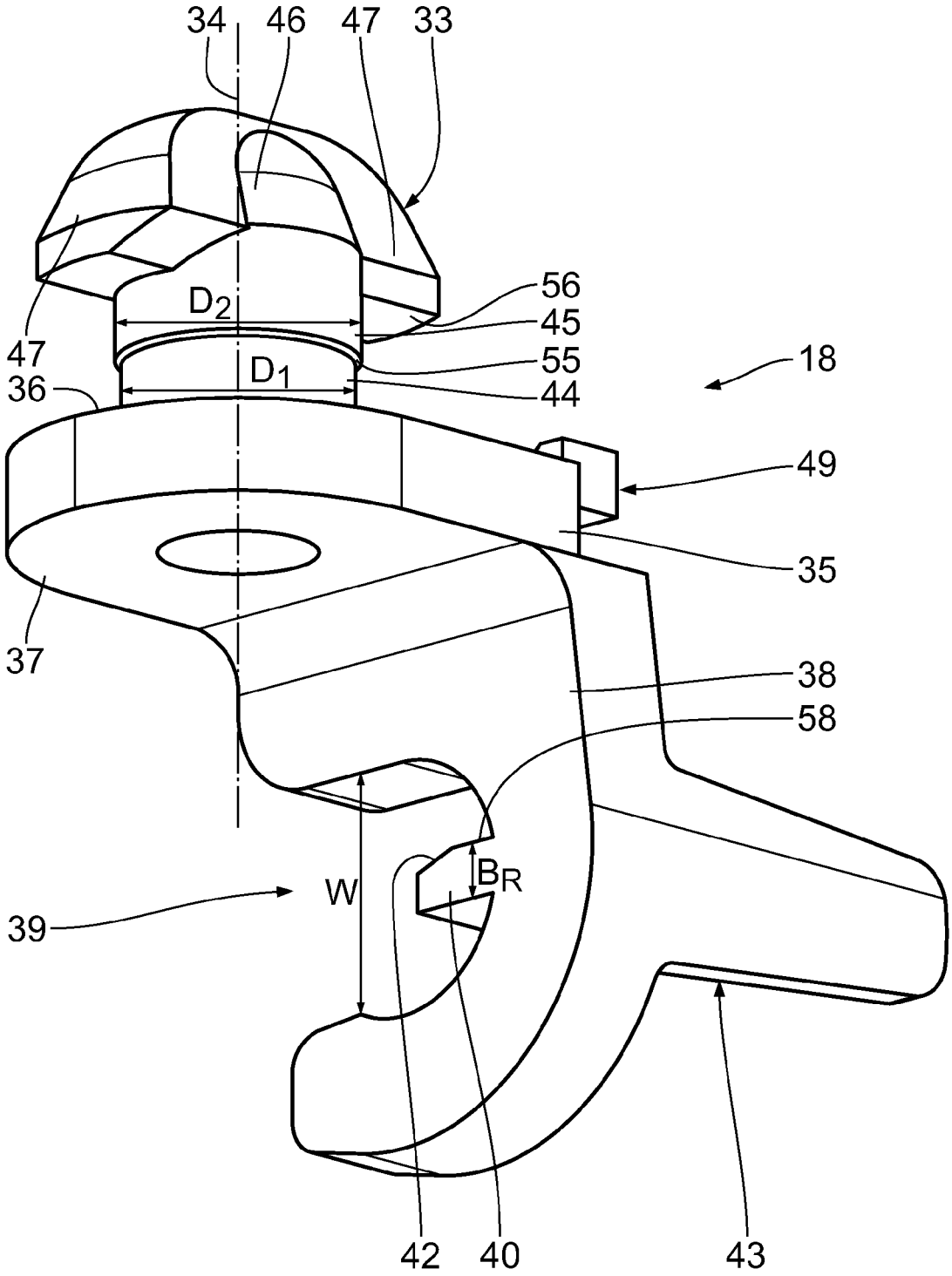

The locking part 18 can be pivoted on the support part 17 about the locking pivot axis 19 between an unlocking position shown in FIG. 2, 3 and a locking position of the coupling device 14 shown in FIGS. 4, 5.

In the following the support part 17 is described in more detail. The support part 17 is configured to be essentially U-shaped. The support part 17 is used for mounting and supporting the friction damper 9. The support part 17 comprises a support plate 21 configured in particular to be planar for bearing on the housing 3 of the washing unit 2. Furthermore, the support part 17 has a support wall 22 extending away perpendicularly and in particular vertically from the support plate 21. On the support wall 22 a pin 24 with a pin longitudinal axis 23 is formed. The pin 24 is used for mounting in the coupling opening 12 of the friction damper 9. The pin 24 extends perpendicularly from the support wall 22. In particular, the pin longitudinal axis 23 is arranged parallel to a plane defined by the support plate 21. The pin 24 has an annular cross section oriented perpendicular to the pin longitudinal axis 23. In a front section facing away from the support wall 22 a truncated cone-shaped insertion surface is provided in order to facilitate the introduction of the pin 24 into the coupling opening 12 of the friction damper 9. The support part 17 is made in one piece for example from polypropylene (PP) or polyoxymethylene (POM) for example by means of an injection molding process.

On an upper side 25 of the support plate 21 facing away from the pin 24 two rectangular holding projections 26 are provided. The holding projections 26 are arranged rigidly on the support plate 21. In this way an improved hold of the support part 17 on the housing 3 of the washing unit 2 is possible. The holding projections 26 are used for securing the position and non-rotation of the coupling device 14 on the washing machine 1. With the upper side 25 the support part 17 is pushed against the housing 3 of the washing unit 2, which is discussed in more detail below. In a plane perpendicular to the locking pivot axis 19 the holding projections 26 each have a square cross section. Also other cross sections for the holding projections 26 are possible.

In the support plate 21 and/or in the support wall 22 one or more reinforcing ribs oriented respectively perpendicularly to a plate-pane or wall plane can be provided in order to increase the structural stability of the support part 17.

Furthermore, in the support plate 21 a second latching recess 27 is provided. The second latching recess 27 passes through the support plate 21 completely. It is also possible to configure the second latching recess 27 such that it is closed to the upper side 25. In particular, from a lower side 28 arranged opposite the upper side 25 the second latching recess 27 is designed to be open. In particular, in the area of the second latching recess 27 the support plate 21 has a rounded or flattened edge 54.

In the support plate 21 also an essentially keyhole-shaped recess 29 is provided. The recess 29 has an insertion section 31 comprising two parallel side walls 30 and a curved section 32 connecting the side walls 30 together. The width B of the insertion section 31 corresponds to a perpendicular spacing of the two opposite side walls 30. The width B of the insertion section 31 is smaller than the diameter of the curved section 32.

In the following the locking part 18 is described in more detail. The locking part 18 comprises a fastening element 33 in the form of a bayonet bolt with a bolt longitudinal axis 34. The bayonet bolt 33 is arranged on a rotational plate 35 and extends essentially perpendicularly from the latter along the bolt longitudinal axis 34. The locking part 18 is made in one piece for example from polypropylene (PP) or polyoxymethylene (POM), in particular in an injection molding process.

The fastening element 33 is formed on an upper side 36 of the rotational plate 35. On a lower side 37 of the rotational plate 35 arranged opposite the upper side 36 a holding plate 38 is formed which extends perpendicularly away from the rotational plate 35. The holding plate 38 is provided eccentric to the bolt longitudinal axis 34 on the locking part 18. The holding plate 38 comprises a pin clamp 39 which is essentially C-shaped, wherein the opening width W of the "C" is smaller than the diameter of a round section 57 of the "C". In particular, the opening width W is smaller than a pin diameter $D_Z$ of the pin 24. On the round section 57 of the "C" a first latching element 40 is provided which can be arranged to latch in a corresponding first latching recess 41 arranged in the pin 24. The first latching recess 41 is provided as a slot-like opening on an outer cylinder casing surface of the pin 24. The first latching recess 41 has a longitudinal orientation which is oriented parallel to the pin longitudinal axis 23. Perpendicular to the longitudinal orientation the slot has a width $B_S$. The first latching element 40 has a width $B_R$, which is smaller than the slot width $B_S$. In order to facilitate the insertion of the first latching element 40 into the first latching recess 41 on a front side of the first latching element 40 facing the opening of the "C" an insertion flank 42 is provided. On an upper side facing the rotational plate 35 the first latching element 40 has a contact surface 58.

On the locking part 18 a lever 43 is formed in one piece. The lever 43 enables the pivoting of the locking part 18 about the locking pivot axis 49. The lever 43 extends perpendicularly, in particular perpendicular to the locking pivot axis 19.

The bayonet-bolt 33 has a round cross-sectional form oriented perpendicular to the bolt longitudinal axis 34. The bayonet bolt 33 has a rotational section 44, to which a fastening section 45 is attached along the bolt longitudinal axis 34. The rotational section 44 has a first diameter $D_1$ oriented perpendicularly to the bolt longitudinal axis 34. The fastening section 45 has a second diameter $D_2$ oriented perpendicularly to the bolt longitudinal axis 34, which is greater than the first diameter $D_1$. In particular: $D_2 \geq 1.05 \cdot D_1$.

A known bayonet section 46 is connected to the fastening section 45 along the bolt longitudinal axis 34. The bayonet section 46 is characterized essentially in that it comprises two bayonet webs 47 diametrically opposite the bolt longitudinal axis 34. Each bayonet web 47 comprises respectively an insertion chamfer 48 auf, which is arranged on a lower side of the bayonet web 47. The insertion chamfers 48 face the upper side 36 of the rotational plate 35.

The locking part 18 comprises a second latching element 49 which is formed in one piece on the rotational plate 35. The second latching element 49 is configured as a latching projection 50 with an insertion oblique 51. The latching projection 50 is arranged on a resilient latching tongue 52. The resilient configuration of the latching tongue 52 is formed in that the latter is separated by a slot passing through the rotational plate 35. Accordingly a spring joint 53 is formed which is oriented perpendicular to the slot and is arranged at one end of the slot. The latching tongue 52 can be pivoted in a resilient manner about the spring joint 53. On a rear side of the latching projection 50 facing away from the insertion oblique 51 the second latching element 49 can have a not shown gripping section so that the second latching element 49 can be activated manually when it is arranged to latch in the corresponding second latching recess 27, i.e. when the coupling device 14 is located in the locking position.

On the rotational section 44 an arresting rib 59 projecting radially relative to the locking pivot axis 19 is provided. The arresting rib 59 extends parallel to the locking pivot axis 19 on the outer cylinder casing surface of the rotational section 44. The arresting rib 59 represents a radial protrusion in the area of the rotational section 44. By means of the arresting rib 59 the first diameter $D_1$ is increased. In particular, the arresting rib 59 is configured such that the contour of the arresting rib 59 is aligned with the cylinder casing surface of the fastening section 45. The arresting rib 59 is arranged with respect to its circumferential position on the rotational section 44 such that on the rotation of the locking part 18 on the support part 17 it represents additional resistance because of the radial thickening of the rotational section 44. The arresting rib enables additional arresting of the locking part 18 on the support part 17. In particular, during the transport of the entire assembly group, which consists of the coupling device 14 and a damper 9 secured thereon, the coupling device 14 is locked securely. The arresting rib is shown in sections in FIG. 2.

In the following the assembly of the locking part 18 on the support part 17 for forming the two-part coupling device 14 is described in more detail. The locking part 18 is arranged with the fastening element 33 in the area of the insertion section 31 of the recess 29 on the support plate 21 of the support part 17. The first diameter $D_1$ of the fastening element 33 in the area of the rotational section 44 is greater than the width B of the insertion section 31. On the basis of the elastic material behavior of the plastic material, from which the support part 17 is made, it is possible to insert the fastening element with the rotational section 44 along the insertion section 31 into the recess 29 until the fastening element with the rotational section 44 is arranged in the curved section 32 of the recess 29. The diameter D of the curved section 32 corresponds essentially to the first diameter $D_1$ of the rotational section 44. The locking part 18 is coupled pivotably with the rotational section 44 of the fastening element 33 in the recess 29 of the support plate 21 about the bolt longitudinal axis 34. In the assembled arrangement of the coupling device 14 the locking pivot axis 19 of the support part 17 and the bolt longitudinal axis 34 of the locking parts 18 coincide.

The second diameter $D_2$ of the fastening section 45 is greater than the diameter of the curved section 32 of the recess 29. This means that the fastening element 33 with an annual shoulder 55 arranged along the bolt longitudinal axis 34 between the rotational section 44 and the fastening section 45 rests on the upper side 25 of the support plate 21. The shoulder 55 forms an axial fastening for axially mounting the fastening element 33 in a direction perpendicular to the support plate 21, in particular along the bolt longitudinal axis 34.

Because the locking part 18 on the rotational section 44 with the fastening element 33 is snapped onto the support plate 21 of the support part 17 the locking part 18 is held reliably and also pivotably on the support part 17.

In the following, the assembly and functioning of the coupling device 14 on the housing 3 of the washing unit 2 is explained in more detail. The assembly of the coupling device 14 on the machine frame 4 is performed in a similar manner and is therefore not explained in detail.

Figure 3:
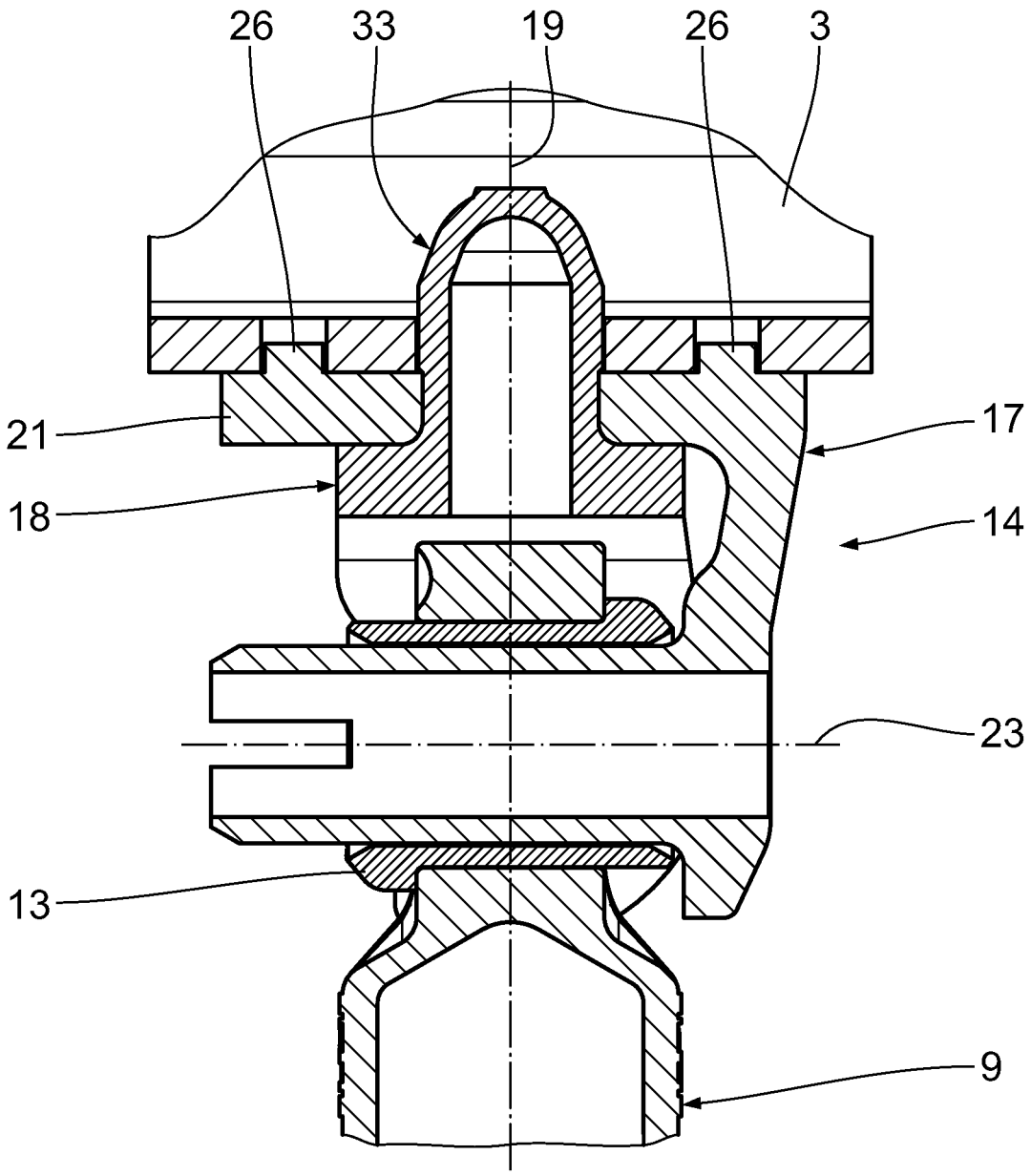
FIG. 3 shows a cross-sectional view along line III-III in FIG. 2.

In FIGS. 2 and 3 the coupling device 14 is shown in the unlocking position. For clarity in FIG. 2 the housing 3 of the washing unit 2 is not shown. The fastening of the coupling device 14 to the housing 3 is shown in particular from the cross-sectional view in FIG. 3. The support part 17 is placed with the support plate 21 on the housing 3, whereby the holding projections 26 engage in recesses of the housing 3 provided for this. At the same time the fastening element 33 of the locking part 18 passes through the recess 29 in the support plate 21 of the support part 17 through a recess provided for this in the housing 3. In this arrangement the coupling device 14 is not secured with the friction damper 9 along the locking pivot axis 19.

The locking of the locking part 18 on the support part 17 and the simultaneous securing of the coupling device 14 on the housing 3 of the washing unit 2 is performed by displacing the coupling device 14 from the unlocking position shown in FIGS. 2, 3 into the locking position shown FIGS. 4, 5. In addition, the locking part 18 is pivoted slightly by 90° about the locking pivot axis 19 on the support part 17. This is possible advantageously by activating the lever 43 manually and in particular without the use of a tool.

In the unlocking position the support plate 21 on the housing 3 of the washing unit 2 is released by the fastening element 33. This means that in a premounted arrangement of the coupling device 14, as shown in FIG. 2, said coupling device 14 can be inserted into a recess provided for this in the housing 3 of the washing unit 2. In the unlocking position the holding plate 38 of the locking part and thereby the pin clamp 39 are arranged spaced apart from the pin 24.

During the pivot movement of the locking parts 18 on the support part 17 firstly the pin clamp 39 bears in the area of the opening of the "C". As the opening width W of the pin clamp 39 is smaller than the pin diameter $D_Z$ and because of the elastic material properties of the material, from which the locking part 18 is made, the pin clamp 39 can be snapped onto the pin 24. At the same time the first latching element 40 can be inserted essentially radially in relation to the pin longitudinal axis 23 into the slot-shaped, first latching recess 41. The insertion of the first latching element 40 into the first latching recess 41 is facilitated by the insertion side 42. The first latching element 40 is positioned on the round section 57 such that the contact surface 58 is arranged along the locking pivot axis 19 above an upper counter surface 60 oriented parallel to the pin longitudinal axis 23. During the insertion of the first latching element 40 into the first latching recess 41 of the pin 24 the contact surface 58 lies against the counter surface 60. The contact surface 58 pushes the counter surface 60 upwards so that the pin 24 is rotated about the pin longitudinal axis 23 in clockwise direction according to the view FIG. 2. The pin 24 is pushed against the round section 57 of the "C".

This means that when locking the locking part 18 on the support part 17 the pin 24 is clamped on the round section 57. In this way the stability of the coupling device 14 as a whole is increased. The coupling device 14 thereby has an increased stability from stresses of the locking pivot axis 19. In particular, it is not necessary that such stresses have to be absorbed solely by the opening of the "C". In this way an additional securing of the pin 24 is ensured in the pin clamp 39.

The holding plate 38 of the locking part 18 and the support wall 22 of the support part 17 are arranged in the locking position parallel to one another and respectively perpendicular to the pin longitudinal axis 23. Between the support wall 22 and the holding plate 38 the friction damper 9 with the coupling opening 12 is secured to the coupling device 14. Both the holding plate 38 and the support wall 22 ensure the axial securing of the friction damper 9 onto the pin 24.

At the same time the displacement of the locking part 18 ensures that the second latching element 49 snaps into the second latching recess 27 provided for this. In this case the latching projection 50 of the second latching element 49 firstly comes into contact in the area of the insertion oblique 51 on the support plate 21 and in particular on the flattened edge 54 provided there. After the pivot movement of the locking part 18 and the fact that the second latching element 49 about the spring joint 53 is configured as a latching tongue 52, the second latching element 49 is pushed downwards, i.e. away from the support plate 21. After completing the pivot movement the second latching element 49 with the latching projection 50 can engage in the latching recess 27 provided for this.

In the locking position of the coupling device 14 the locking part 18 is secured reliably to the support part 17. This is ensured in particular by the pin clamp 39 held on the pin 24, the first latching element 40 locked into the first latching recess 41 and the second latching element 49 locked into the second latching recess 27. The coupling device 14 thus has a multiply securing fastening system.

Furthermore, the coupling device 14 in the locking position is held reliably on the housing 3 of the washing unit 2. As shown in particular in FIG. 5 the fastening element 33 with the bayonet webs 47 is arranged on the housing 3 such that the webs project laterally on the recess in the housing 3. The bayonet webs 47 grip behind the recess of the housing 3 and thereby establish the axial securing of the coupling device 14 along the locking pivot axis 19. The bayonet bolt 33 can be configured in particular with the bayonet webs 47 such that a distance aligned parallel to the bolt longitudinal axis 34 from an lower side 56 of a bayonet web 47 to the upper side 36 of the rotational plate 35 is smaller than the sum of the wall thicknesses of the housing 3 of the washing unit 2 and the support plate 21 of the support part 17. In this case the securing of the coupling device 14 on the washing unit 2 is increased additionally as in the locking position the housing 3 and the support plate 21 are clamped between the bayonet webs 47 and the rotational plate 35 (cf. FIG. 5). This means that in the locking position of the housing 3 and the support plate 21 a passive reaction force acts on the lower side 56 of the bayonet bolt 33 or on the upper side 36 of the rotational plate 35. The bayonet rotary closure is configured to be self-locking.

What is claimed is:

1. A coupling device for coupling a friction damper comprising at least one coupling opening onto one of a washing unit and a machine frame of a washing machine, wherein the coupling device comprises a. a support part for supporting the friction damper, wherein the support part comprises
   i. a support plate for putting on one of the washing unit and the machine frame,
   ii. a support wall extending away transversely from the support plate,
   iii. a pin having a pin longitudinal axis for mounting in the at least one coupling opening, wherein the pin extends away transversely from the support wall, and b. a locking part coupled pivotably to the support part about a locking pivot axis between a locking position and an unlocking position for locking the friction damper onto the support part, wherein the locking part comprises a fastening element, c. wherein in the locking position the support plate is secured onto one of the washing unit and the machine frame by means of the fastening element, and d. wherein in the unlocking position the support plate on one of the washing unit and the machine frame is released by the fastening element.

2. A coupling device according to claim 1, comprising a lever formed on the locking part for pivoting the locking part, wherein the lever extends transversely to the locking pivot axis.

3. A coupling device according to claim 1, comprising a lever formed on the locking part for pivoting the locking part, wherein the lever extends perpendicularly to the locking pivot axis.

4. A coupling device according to claim 1, wherein the locking part is made in one piece from a first material.

5. A coupling device according to claim 1, wherein the locking part is made in one piece from plastic.

6. A coupling device according to claim 1, wherein the support part is made in one piece from a second material.

7. A coupling device according to claim 1, wherein the support part is made in one piece from plastic.

8. A coupling device according to claim 1, wherein the locking part and the support part are made from different materials.

9. A coupling device according to claim 1, wherein the locking part and the support part are made from polypropylene and polyoxymethylene.

10. A coupling device according to claim 1, comprising at least one holding projection arranged on the support plate.

11. A coupling device according to claim 1, wherein the fastening element is arranged in a recess provided in the support plate.

12. A coupling device according to claim 11, wherein the fastening element comprises an axial fastening for axially securing along a direction oriented perpendicular to the support plate.

13. A coupling device according to claim 1, comprising at least one latching element for latching the locking part onto the support part in the locking position.

14. A coupling device according to claim 13, comprising a first latching element arranged on a pin clamp, wherein the first latching element in the locking position is arranged latched in a corresponding first latching recess arranged in the pin.

15. A coupling device according to claim 13, comprising a second latching element, wherein the second latching element in the locking position is arranged in a corresponding second latching recess arranged in the support plate.

16. A coupling device according to claim 15, wherein the second latching element is configured as a latching projection on a resilient latching tongue, which can be activated manually.

17. A coupling device according to claim 15, wherein the second latching element is configured as a latching projection on a resilient latching tongue, which can be activated in the locking position.

18. A coupling device according to claim 1, comprising a holding plate arranged eccentrically to the locking pivot axis with a pin clamp, wherein the pin clamp in the locking position encompasses the pin at least in sections, and wherein the pin clamp in the unlocking position is arranged spaced apart from the pin.

19. A coupling device according to claim 1, comprising at least one insertion chamfer arranged on a lower side of the fastening element facing towards the support plate.

20. A coupling device according to claim 1, wherein the fastening element is a bayonet bolt having a bolt longitudinal axis.

* * * * *